US006287387B1

(12) United States Patent
Lee et al.

(10) Patent No.: US 6,287,387 B1
(45) Date of Patent: Sep. 11, 2001

(54) APPARATUS AND METHOD FOR LOCKING A BASKET IN A CLEANING BATH

(75) Inventors: Jui-Hsiung Lee, Feng-San; Kuo-Hsien Yen; Chien-Shun Lien, both of Hsin-Chu, all of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/324,135

(22) Filed: Jun. 2, 1999

(51) Int. Cl.[7] ..... B08B 3/12

(52) U.S. Cl. ..... 134/1; 134/25.4; 134/32; 134/140; 134/147

(58) Field of Search ..... 134/1, 3, 25.2, 134/25.3, 25.4, 32, 76, 83, 92, 135, 137, 140, 147, 164, 165; 118/425, 428

(56) References Cited

U.S. PATENT DOCUMENTS

| | | | | |
|---|---|---|---|---|
| 519,091 | * | 5/1894 | Noble | 134/147 X |
| 1,143,858 | * | 6/1915 | Pearman | 134/164 |
| 1,593,417 | * | 7/1926 | Barley | 134/140 |
| 2,525,164 | * | 10/1950 | Ackles | 118/425 X |
| 3,464,429 | * | 9/1969 | Ehrhardt | 134/140 |
| 4,377,986 | * | 3/1983 | Juve | 134/76 X |
| 4,817,650 | * | 4/1989 | Tilton | 134/135 X |
| 5,850,842 | * | 12/1998 | Sweeney et al. | 134/140 |

* cited by examiner

*Primary Examiner*—Philip R. Coe
(74) *Attorney, Agent, or Firm*—Tung & Associates

(57) ABSTRACT

An apparatus and a method for locking a wire basket or a pod carrier basket in a support base for cleaning in an ultrasonic cleaning bath are provided. In the apparatus, a support base is constructed of an open bottom panel and four vertical posts emanating upwardly from four corners of the bottom panel adapted for moving upwardly and downwardly in the cleaning bath. At last two locking means each mounted on a diagonally opposing vertical post are provided and each equipped with a hook or catch for locking onto one of the two horizontal handle bars provided on a wire basket that is positioned in the support base. The present invention novel locking means for locking a wire basket in a support base allows a wire basket that has lightened load to be positioned in the support base without causing bodily injury to a machine operator, and allows the wire basket to be securely locked in the support base during an ultrasonic cleaning procedure without the basket floating problem. The present invention novel apparatus and method therefore not only prevents bodily injury to a machine operator for operating a heavy wire basket, but also prevents the tilting over of a lightened wire basket during a cleaning process.

20 Claims, 1 Drawing Sheet

APPARATUS AND METHOD FOR LOCKING A BASKET IN A CLEANING BATH

FIELD OF THE INVENTION

The present invention generally relates to an apparatus and a method for cleaning a semiconductor fabrication tool in an ultrasonic bath and more particularly, relates to an apparatus and a method for locking a basket loaded with semiconductor fabrication tools in a support base for lowering into an ultrasonic cleaning bath such that the basket does not move during the cleaning procedure.

BACKGROUND OF THE INVENTION

In semiconductor processing, a large portion of the yield losses can be attributed to contaminations by particles and films of various nature. The contaminants may be organic or inorganic particles, films formed of polymeric bases, or other ionic based materials. The particles or films may be generated as byproducts in the reaction of reactant gases, by the surrounding environment, by the processing equipment or by the handling of manufacturing personnel. Some contaminants are particles or films generated from condensed organic vapors, solvent residues, photoresist or metal oxide compounds.

Typical problems and the detrimental effects caused by particle or film contaminants are poor adhesion of deposited layers, poor-formation of LOCOS oxides, or poor etching of the underlying material. The electrical properties and the stability of devices built on the semiconductor substrate may also be seriously affected by ionic based contaminants. The various forms of contaminants therefore not only reduce the product yield but also degrades the reliability of the devices built. For instance, contaminant particles can cause a device to fail by improperly defined patterns, by creating unpredictable surface topography, by inducing leakage current through insulating layer, or otherwise reducing the device lifetime. It is generally recognized that a particle contaminant that exceeds one-fifth to one-half of a minimum feature size on a device has the potential of causing a fatal defect, i.e. a defect that causes a device to fail completely. A defect of smaller size may also be fatal if it falls in a critical area, for instance, a particle contaminant in the gate oxide layer of a transistor. In modern high density devices, such as a dynamic random access memory chip, the maximum allowable number of particle contaminants per unit area of the device must be reduced accordingly in order to maintain an acceptable yield and reliability.

For instance, in new process technologies that are developed for 64~M Bit DRAM products, the process environment required by the technologies are so stringent that the complete enclosure of the process environment for each process tool is contemplated. The enclosure of the process environment for the process tool results in the creation of a minienvironment concept for the process technologies. Within the enclosure of a minienvironment, an extremely high cleanliness class, i.e., about 0.1 at 0.1 $\mu$m, is realized, while the overall production area may have a cleanliness class of 1,000. In order to achieve such cleanliness, the wafer processing and loading/unloading sections of the process equipment must be handled by automated input/output devices. The transport of wafers outside the minienvironment is frequently performed by SMIF pods which keep wafers in a clean condition separated from the outside production environment.

In order to keep the wafers in a state of high cleanliness, the SMIF pods and the wafer cassettes positioned in the pods for holding wafers must be periodically cleaned in a cleaning bath filled with a solvent with ultrasonic energy. In the ultrasonic cleaning bath, a wire basket filled with SMIF pods to be cleaned is first positioned in a support base. The support base with the wire basket is then lowered into a cleaning bath filled with a cleaning solvent such as deionized water (or DI water). The wire basket is made large enough for holding two 8 inch SMIF pod covers or four 6 inch SMIF pod covers frequently resulting in a heavy basket with a weight of approximately 8 kg.

The wire basket is equipped with two horizontal handle bars attached to the two side panels on the basket. To initiate a cleaning operation, an operator must manually lift a wire basket by the two horizontal handle bars and position it into the support base such that the basket may be lowered into the cleaning solvent contained in the cleaning bath. The weight of the wire basket, i.e., the weight of the pod covers plus the weight of the basket itself is sufficient to hold the basket in a stable condition during the ultrasonic cleaning process. The conventional cleaning apparatus described above presents a serious personal injury issue to a machine operator due to the large weight, i.e., approximately 8 kg, of the wire basket that must be lifted and positioned by hand. In order to avoid the personal injury issue, the wire basket is usually loaded not to its full load but instead, only to approximately 70% of the full load or about 5.4 kg. This reduces the personal injury issue at the cost of another processing problem. When the weight of the wire basket is reduced to about 5.4 kg, the wire basket does not have sufficient weight to be held in a stable position during the ultrasonic cleaning process, i.e., the wire basket tends to float in the cleaning solvent. As a result, there is a danger of displacement of the basket from its position in the support base or even the danger of the basket; in flipping over. It is therefore desirable to provide an apparatus that is equipped with locking means capable of locking a wire basket to a support base during an ultrasonic cleaning process such that the lightweight of the basket does not affect the operation of the cleaning process.

It is therefore an object of the present invention to provide an apparatus for cleaning semiconductor tools in a cleaning bath that does not have the drawbacks or shortcomings of the conventional cleaning apparatus.

It is another object of the present invention to provide an apparatus for holding a wire basket in a support base for cleaning in an ultrasonic cleaning process.

It is a further object of the present invention to provide an apparatus for locking a basket in a support base for cleaning semiconductor processing tools loaded in the basket in an ultrasonic cleaning process.

It is another further object of the present invention to provide an apparatus for locking a basket in a support base for cleaning semiconductor processing tools loaded in the basket wherein the basket is locked into the support base by at least two diagonally mounted locking means.

It is still another object of the present invention to provide an apparatus for locking a wire basket to a support base during an ultrasonic cleaning process such that the basket is held in a stable position without the danger of tilting over.

It is yet another object of the present invention to provide an apparatus for locking a wire basket in a support base immersed in a cleaning bath filled with deionized water and energized with ultrasonic energy.

It is still another further object of the present invention to provide a method for locking a wire basket in a support base immersed in a cleaning solution such that ultrasonic energy can be applied to a cleaning solvent contained in the bath for cleaning semiconductor processing tools contained in the basket.

It is yet another further object of the present invention to provide a method for locking a basket in a support base for cleaning in an ultrasonic cleaning bath wherein locking means are provided on the support base which may be slidingly adjusted to accommodate wire baskets of various heights.

SUMMARY OF THE INVENTION

In accordance with the present invention, an apparatus and a method for locking a wire basket in a support base for cleaning semiconductor tools loaded in the basket in an ultrasonic cleaning process are provided.

In a preferred embodiment, an apparatus for locking a wire basket in a cleaning bath is provided which includes a support base constructed of an open bottom panel and four vertical posts emanating upwardly from four corners of the bottom panel, the support base is adapted for moving upwardly and downwardly in the cleaning bath, a wire basket of substantially rectangular shape equipped with two oppositely mounted horizontal handle bars on two sides of the basket, and at least two diagonally mounted locking means each mounted on an opposing vertical post and equipped with a catch for locking onto one of the two handle bars.

The apparatus for locking a basket in a cleaning bath may further include motor means for moving the support base upwardly and downwardly in the cleaning bath, roller means on the support base for rolling on inner walls of the cleaning bath when moving upwardly or downwardly. The locking means may be adapted to slidingly engaging the vertical posts and to lock at a height corresponding to a height of a wire basket. The cleaning bath may be an ultrasonic cleaning bath.

In the apparatus for locking a basket in a cleaning bath, the catch on the locking means may be spring loaded and pivotable in a clockwise direction when the support base is moved upwardly onto a wire basket for the catch to lock onto a handle bar on the wire basket. The cleaning bath may be filled with a cleaning solvent, such as deionized water. The locking means may further include two halves assembled together by mechanical means, such as screws.

The present invention is further directed to a method for locking a basket in a cleaning bath that can be carried out by the operating steps of first providing a support base that is constructed of an open bottom panel and four vertical posts emanating upwardly from four corners of the bottom panel, the support base is adapted for moving upwardly and downwardly in the cleaning bath, providing a wire basket of substantially rectangular shape that is equipped with two oppositely mounted horizontal handle bars on two sides of the basket, providing at least two diagonally mounted locking means each is mounted on an opposing vertical post and is equipped with a catch for locking onto one of the two handles, positioning the wire basket in a fixed position over the support base, and moving the support base upwardly toward the wire basket until the locking means latches onto the horizontal handle bas on the two sides of the basket.

The method for locking a basket in a cleaning bath may further include the step of lowering the support base with the basket locked therein into a cleaning solvent. The cleaning solvent used may be deionized water. The method may further include the steps of providing the locking means with a spring-loaded latch that is pivotable, and locking onto the horizontal handle.

The method may further include the steps of providing the locking means in two halves that are fastened together by screws, installing a pivotable spring-loaded latch in one of the two halves, and locking the pivotable spring-loaded latch onto a horizontal handle bar on the basket.

The method for locking a basket in a cleaning bath may further include the step of adjusting a position of the locking means on the vertical posts by loosening mounting screws and slidingly adjusting its position. The method for locking a basket in a cleaning bath may further include the step of applying an ultrasonic energy to the cleaning solvent, loading pod covers into the basket for cleaning in the cleaning solvent, loading cassette carriers into the basket for cleaning in the cleaning solvent energized by ultrasonic energy, or cleaning objects loaded into the basket and immersed in the cleaning solvent with ultrasonic energy for at least two minutes.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1:
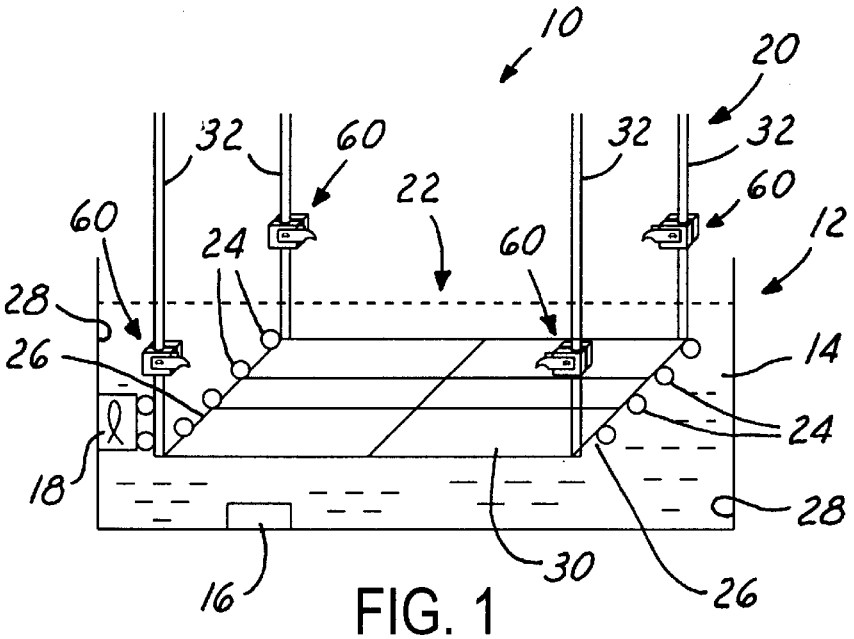
Referring now to FIG. 1, wherein a present invention ultrasonic cleaning bath 10 is shown in a perspective view. In the ultrasonic cleaning apparatus 10, a cleaning solvent container 12 is first provided to hold a cleaning solvent 14 therein. The cleaning solvent can be of any suitable solvent for use in an ultrasonic cleaning tank, one of such suitable solvent is deionized water. The ultrasonic energy source 16 is normally mounted on the tank 12 for supplying ultrasonic vibration to the cleaning solvent 14 contained in the tank.

The present invention discloses an apparatus and a method for locking a wire basket in a cleaning bath by first locking the basket to a support base and then lowering the support base into a cleaning solvent contained in the cleaning bath. The present invention novel apparatus allows a loaded basket of lighter weight to be used by machine operators such that personal injury caused by lifting of heavy baskets can be avoided, while at the same time, the floating or instability problem of the wire basket when immersed in a cleaning solvent is also avoided.

The present invention novel apparatus, while demonstrated in a preferred embodiment by the cleaning process of SMIF pods and wafer cassettes, can be suitable used in cleaning any other parts in an ultrasonic cleaning bath.

In the present invention ultrasonic cleaning bath for pod cleaning, a pod carrier basket may be positioned in a mechanical up-and-down support base. When the cleaning operation is started, the support base and the loaded wire basket descend to the bottom of the cleaning bath. During the ultrasonic cleaning operation the weight of the loaded basket holds its position in a stable condition on the bottom of the support base. Since a fully loaded pod carrier basket has a weight not suitable for hand-lifting by a machine operator, the total weight of the carrier basket is reduced which leads to an unstable basket during an ultrasonic cleaning step. The present invention novel clamping device equipped with a hook catch can be installed on four vertical frames (or vertical posts) of the support base to hold the position of a lightened pod carrier basket.

The present invention provides the novel advantage that no major structural change on the original design of the support frame or base is necessary. The fixing clamp or locking means can be easily installed on the support base frames, and the positions of the clamps can be easily adjusted according to the height of the pod carrier basket.

The present invention novel apparatus for locking a wire basket in a support base for use in an ultrasonic cleaning bath further provides the benefit that it enables the use of reduced load pod carrier basket to be operated in the ultrasonic wash bath. It eliminates the possibility of unstable floating of the carrier basket when positioned inside the bath during the ultrasonic washing operation. It further prevents any bodily injury to the machine operator caused by operating a heavy basket.

In the novel apparatus provided by the present invention, a locking clamp, or a fixing clamp is designed and installed for holding the pod carrier basket stablely in a support base or frame. The locking clamp consists of a stainless steel body formed of two halves, a stainless steel spring and a Teflon hook (or latch) and a stopper. Before descending a support base into a cleaning bath, a loaded basket is first horizontally positioned into the support base by an operator, clamps are then installed on each vertical frame for the support base to lock onto the handle of the basket. The positions of the clamps are thus fixed for future cleaning cycles. When the cleaning process is completed, the basket may be pulled out horizontally from the support base without taking out the clamps. In order to load the next basket onto the support base for performing the next cleaning operation without taking out the clamps, the hooks on the clamps are designed such that they allow a basket handle to move from the top of the hook downwardly, but with a stopper installed to prevent the handle from moving backwards to the other side of the hook.

Referring now to FIG. 1, wherein a present invention ultrasonic cleaning bath 10 is shown in a perspective view. In the ultrasonic cleaning apparatus 10, a cleaning solvent container 12 is first provided to hold a cleaning solvent 14 therein. The cleaning solvent can be of any suitable solvent for use in an ultrasonic cleaning tank, one of such suitable solvent is deionized water. The ultrasonic energy source 16 is normally mounted on the tank 12 for supplying ultrasonic vibration to the cleaning solvent 14 contained in the tank.

A support base, or support frame 20 is positioned inside the tank and fits snugly in the tank cavity 22 with roller devices 24 mounted on the two side frames 26 of the support base 20. The roller devices 24 are mounted such that they roll up-and-down on the inner walls 28 of the cleaning tank 12. For clarity reasons, this is not shown in FIG. 1, i.e., the roller devices 24 are shown spaced apart from the inner walls 28.

The support base 20 is constructed with an open bottom panel 30 for allowing cleaning solvent 14 to freely flow therethrough, and with vertically positioned frames or posts 32 that emanate upwardly from the four corners of the open bottom panel 30. In operation, the support base 20 moves upwardly and downwardly on a track system 18 by motor means (not shown) to engage or disengage with a loaded pod carrier basket (or a wire basket) 40 as shown in FIG. 3A.

Figure 2:
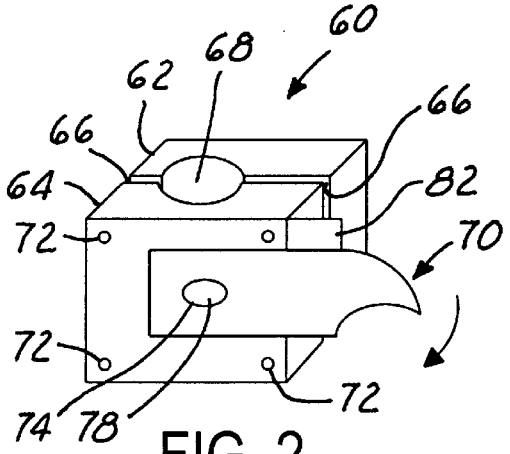
FIG. 2 is an enlarged, perspective view of the locking means fastened on the vertical posts of the support base.
Figure 3A:
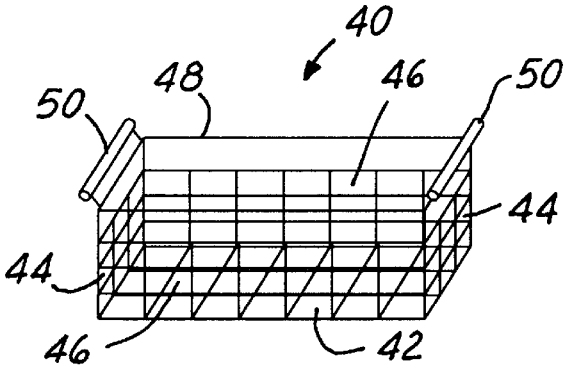
FIG. 3A is a perspective view of a wire basket for holding parts to be cleaned and for mounting in the support base.
Figure 3B:
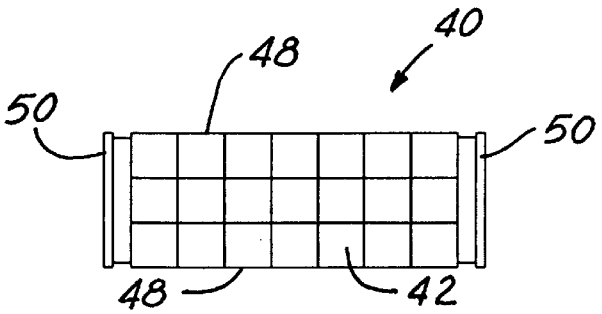
FIG. 3B is a plane view of the wire basket of FIG. 3A showing the horizontal handle bars mounted on both sides of the basket.

The wire basket 40, or the pod carrier basket is shown in a perspective view in FIG. 3A, while a plane view of the wire basket 40 is shown in FIG. 3B. The wire basket 40 is constructed by a wire framed bottom panel 42, two side panels 46 and two end panels 44. On a top frame 48 two horizontally position handle bars 50 are provided for easy gripping of the handle and for lifting of the wire basket 40. It should be noted that the horizontal handle bar 50 and the panels 42, 44 and 46 should be constructed of an anti-corrosion material such as stainless steel such that they survive long term exposure to various cleaning solvents. The handle bar 50 should be fabricated in a suitable dimension, i.e., a suitable diameter, such that it may be locked, or latched by the present invention novel locking means 60. A detailed perspective view of the locking means, or the fixing clamp 60 is shown in FIG. 2.

The locking means 60 is constructed by two substantially equal halves 62, 64 fabricated in a corrosion-resistant metal such as stainless steel. The inner surfaces 66 of the two halves 62, 64 are further provided with a cavity 68 for clamping to the vertical posts 32 on the support base 20. The clamping can be achieved by any suitable mechanical means. One of such mechanical means is by screws 72 shown in FIG. 2. On one of the halves 64, a hook or catch 70 is mounted at a center mounting aperture 74 by a spring 78. The hook or catch 70 may be suitably fabricated of a Teflon material for utilizing its desirable properties of high chemical resistance and high lubricity. On the hook 70, a mechanical stop 82 is mounted such that the hook 70 may only pivot in a clockwise direction, but not in a counter-clockwise direction.

In operation, when the locking means 60 are mounted on each of the vertical posts 32 of the support base 20, at a suitable height that is approximately the height of the wire basket 40 at the horizontal handle bar 50, the support base 20 can be operated to automatically load the wire basket 40. For instance, the wire basket 40 is first fixed in a suitable position above the support base 20, i.e., suspended above the cleaning tank 12, the support base 20 is then moved up on its track (not shown) by the motor means until the hook 70 touches the underside of the horizontal handle bar 50 and pivots downwardly to allow the hook 70 to clear the handle bar 50 and then spring back to its original horizontal position as shown in FIG. 2. At this time, the wire basket is locked into the support base 20 by the operation of the locking means 60 latching onto the horizontal handle bar 50.

It should be noted that, while four locking means 60 are shown in FIG. 1 mounted on the four vertical posts 32, only two diagonally mounted locking means 60 may be necessary to adequately latch or lock the horizontal handle bars 50 (and thus the wire basket 40) in place. Even though, when four locking means 60 as shown in FIG. 1 are utilized, a more stable locking position of the wire basket 40 is achieved.

It should also be noted that the locking means 60, with its clamp-shell construction shown in FIG. 2, can be suitably adjusted for their positions on the vertical posts 32 by a sliding motion and by first loosening the screws 72. When a different-sized wire basket 40 is utilized which may have a different height for the horizontal handle bar 50, the location of the locking means 60 on the vertical post 32 can be suitably adjusted. This allows the versatility of using any suitable sized wire basket in the present invention novel support base that is equipped with the novel locking means 60.

The present invention novel apparatus and a method for locking a basket in a support base for use in an ultrasonic cleaning bath have therefore been amply described in the above descriptions and in the appended drawings of FIGS. 1~3B.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

1. An apparatus for locking a basket in a cleaning bath comprising:

a support base constructed of an open bottom panel and four vertical posts emanating upwardly from four corners of said open bottom panel adapted for moving upwardly and downwardly in said cleaning bath, a wire basket of substantially rectangular shape equipped with two oppositely mounted horizontally handles on two sides of said basket, and at least two locking means each mounted on an diagonally opposing vertical post and equipped with a catch for latching onto one of said two handles.

2. An apparatus for locking a basket in a cleaning bath according to claim 1 further comprising motor means for moving said support base upwardly and downwardly in said cleaning bath.

3. An apparatus for locking a basket in a cleaning bath according to claim 1 further comprising roller means mounted on said support base for rolling on inner walls of said cleaning bath during an up-and-down movement of said support base.

4. An apparatus for locking a basket in a cleaning bath according to claim 1, wherein said locking means being adapted to slidingly engaging said vertical post and to locking at a height corresponding to a height of a wire basket.

5. An apparatus for locking a basket in a cleaning bath according to claim 1, wherein said cleaning bath is an ultrasonic cleaning bath.

6. An apparatus for locking a basket in a cleaning bath according to claim 1, wherein said catch on said locking means is spring loaded and pivotable in a clockwise direction when said support base is moved upwardly onto a wire basket for said catch to lock onto a handle on said wire basket.

7. An apparatus for locking a basket in a cleaning bath according to claim 1, wherein said cleaning bath is filled with a cleaning solvent.

8. An apparatus for locking a basket in a cleaning bath according to claim 1, wherein said cleaning bath is filled with deionized water.

9. An apparatus for locking a basket in a cleaning bath according to claim 1, wherein said locking means comprises two clamped-shell shaped halves assembled together by mechanical means.

10. An apparatus for locking a basket in a cleaning bath according to claim 1, wherein said locking means comprises two halves assembled together by screws.

11. A method for locking a basket in a cleaning bath comprising the steps of providing a support base constructed of an open bottom panel and four vertical posts emanating upwardly from four corners of said bottom panel adapted for moving upwardly and downwardly in said cleaning bath, a wire basket of substantially rectangular shape equipped with two oppositely mounted horizontal handles on two sides of said basket, at least two locking means each mounted on an diagonally opposing vertical post and equipped with a catch for locking onto one of said two handles, positioning said wire basket in a position over said support base, and moving said support base upwardly toward said wire basket until said locking means latches onto said horizontal handles on said two sides of the basket.

12. A method for locking a basket in a cleaning bath according to claim 11 further comprising the step of lowering said support base with said basket locked therein into a cleaning solvent.

13. A method for locking a basket in a cleaning bath according to claim 12, wherein said cleaning solvent used is deionized water.

14. A method for locking a basket in a cleaning bath according to claim 12 further comprising the step of applying an ultrasonic energy to said cleaning solvent.

15. A method for locking a basket in a cleaning bath according to claim 14 further comprising the step of loading pod covers into said basket for cleaning in said cleaning solvent.

16. A method for locking a basket in a cleaning bath according to claim 14 further comprising the step of loading cassette carriers into said basket for cleaning in said cleaning solvent energized by ultrasonic energy.

17. A method for locking a basket in a cleaning bath according to claim 14 further comprising the step of cleaning objects loaded into said basket and immersed in said cleaning solvent with ultrasonic energy for at least 2 min.

18. A method for locking a basket in a cleaning bath according to claim 11 further comprising the steps of:

providing said locking means with a spring-loaded latch that is pivotable and, locking said spring-loaded latch onto said horizontal handle.

19. A method for locking a basket in a cleaning bath according to claim 11 further comprising the steps of:

providing said locking means in two halves that are fastened together by screws, installing a pivotable, spring-loaded latch in one of said two halves, and locking said pivotable, spring-loaded latch onto a horizontal handle on said basket.

20. A method for locking a basket in a cleaning bath according to claim 11 further comprising the step of adjusting a position of said locking means on said vertical post by loosening mounting screws and slidingly adjusting its position.

* * * * *